United States Patent [19]

Hope et al.

[11] 4,324,354

[45] Apr. 13, 1982

[54] APPARATUS FOR PROCESSING PHOTOGRAPHIC MATERIALS

[76] Inventors: Henry F. Hope; Stephen F. Hope, both of 2421 Wyandotte Rd., Willow Grove, Pa. 19090

[21] Appl. No.: 159,122

[22] Filed: Jun. 13, 1980

[51] Int. Cl.[3] ..... B65H 17/22; G03D 3/08

[52] U.S. Cl. ..... 226/189; 74/421 R; 354/319

[58] Field of Search ..... 226/183, 188, 189, 181, 226/90, 91, 92; 354/319, 320, 322; 74/421 R

[56] References Cited

U.S. PATENT DOCUMENTS

| | | | |
|---|---|---|---|
| 3,025,779 | 3/1962 | Russell | 95/94 |
| 3,067,919 | 12/1962 | Kunz | 226/188 |
| 3,072,310 | 1/1963 | Kunz | 226/188 |
| 3,147,090 | 9/1964 | Russell | 34/160 |
| 3,345,928 | 10/1967 | Krehbiel | 95/94 |
| 3,532,048 | 10/1970 | Hope | 95/94 |
| 3,656,676 | 4/1972 | Hope | 226/92 |
| 3,779,439 | 12/1973 | Fessop | 226/88 |
| 3,952,610 | 4/1976 | Hope | 74/421 R |
| 3,989,176 | 11/1976 | Hope | 226/189 |
| 4,026,451 | 5/1977 | Hope | 226/91 |
| 4,079,635 | 3/1978 | Hope | 74/421 R |
| 4,118,998 | 10/1978 | Hope | 74/421 R |

*Primary Examiner*—Edward J. McCarthy

*Attorney, Agent, or Firm*—Z. T. Wobensmith, II; Z. T. Wobensmith, III

[57] ABSTRACT

Apparatus for processing photographic materials is disclosed and more specifically equipment for turnaround during processing of an elongated web of photographic material at the midportion of a processing operation, the web being guided in part by inner and outer rollers with interposed hollow vanes for liquid delivery through openings on one face to guide the web in an arcuate path.

7 Claims, 3 Drawing Figures

APPARATUS FOR PROCESSING PHOTOGRAPHIC MATERIALS

BACKGROUND OF THE INVENTION

1. Field of the Invention

This invention relates to apparatus for processing photographic materials.

2. Background of the Prior Art

It has heretofore been proposed to provide roller transport apparatus for processing photographic materials in web form in tanks containing chemicals in solution and washing liquid, and in which the web is moved downwardly in the tank, then, at or near the bottom of the tank is turned and moved upwardly for delivery to another tank or for drying. One of the problems which has been encountered is in the turnaround at the bottom of the tank.

It has been proposed, as part of the turnaround apparatus, to provide fixed guide plates or shoes, as shown in the U.S. Pat. Nos. to Kunz, 3,072,310; Hope et al., 3,532,048, 3,656,676 and 3,952,610. Such guide plates have a tendency to scratch or streak the web being processed.

It has also been proposed, as part of the turnaround apparatus, to guide the web with rollers as shown in the U.S. Pat. Nos. to Kunz, 3,067,919; Russell et al., 3,025,779 and 3,147,090; Krehbiel, 3,345,928; Hope et al., 3,952,610, 3,989,176, 4,026,451, 4,079,635 and 4,118,998. With the use of such guide rollers it is important that the centers of the shafts be properly located to provide a smooth advance of the web with avoidance of scratching of the web. The use of nip rollers is troublesome because of the difficulty in maintaining constant pressure on the web to avoid slipping because of insufficient pressure and to avoid pinching and bruising which can occur with excessive pressure.

SUMMARY OF THE INVENTION

In accordance with the invention the turnaround apparatus includes guide rollers for engaging the web and interposed vanes with liquid discharge for directing a leading edge of the web and the web itself to facilitate the advance of that edge and the web which follows.

It is the principal object of the invention to provide improved apparatus for processing photographic material in web form and more specifically the turnaround at the bottom of the processing tank by the use of vanes for liquid discharge to aid in the advance of the leading edge of a web and of the web itself.

It is a further object of the invention to provide improved apparatus for processing photographic material in web form by the use of vanes for liquid discharge against a web to aid in the movement thereof.

It is a further object of the invention to provide apparatus of the character aforesaid with which improved handling of the web is effected.

It is a further object of the invention to provide a turnaround for web processing with which the likelihood of damage to the web during processing is great reduced.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings, end frames 15 and 16 are shown, of any suitable material, including metal or plastic, of sufficient strength and resistant to the chemicals and liquids to which they are exposed in use. The bearings and bushings employed in the end frames 15 and 16 have been omitted in the interest of clarity.

Figure 2:
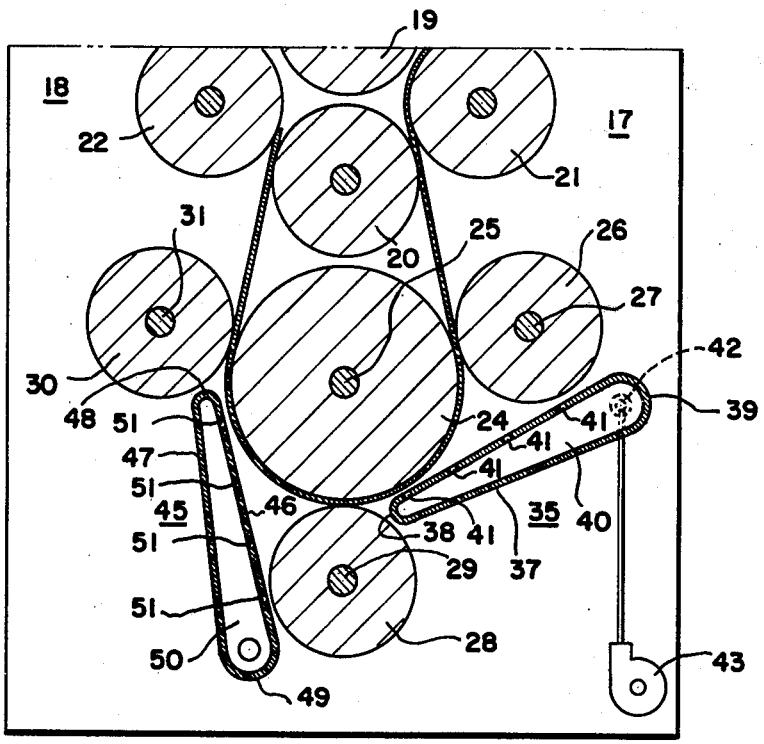
FIG. 2 is an end elevational view of the apparatus of FIG. 1 of the present invention but with the hollow vanes shown in section on the line 2—2 of FIG. 1.
Figure 3:
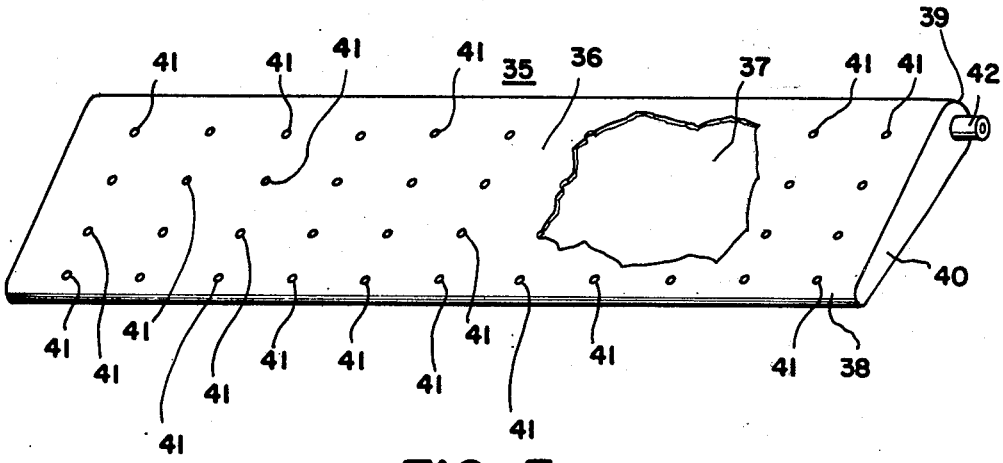
FIG. 3 is a perspective of the vane removed from the apparatus.

The end frames 15 and 16 are held in assembled and spaced relation in a well known manner by frame rods (not shown). The downfeed and upfeed sections of the roller transport for the web can be of well known type such as those shown in our prior U.S. Pat. Nos. 3,952,610, 4,026,451, 4,079,635 and 4,118,998. Fragmentary portions of the downfeed sections 17 and upfeed section 18 are shown on FIG. 2 as central rollers 19 and 20 rotating clockwise, a downfeed roller 21 and an upfeed roller 22 contiguous to the central rollers 19 and 20.

The turnaround at the lower part of the end frames 15 and 16 and immediately below the downfeed rollers 19, 20 and 21 and the upfeed rollers 19, 20 and 22, preferably includes a central roller 24 on a shaft 25 rotatably supported in the end frames 15 and 16 with a contiguous downfeed roller 26 on a shaft 27 carried by the end frames 15 and 16 with its center above that of the shaft 25.

Below the roller 24, a roller 28 is provided, carried on a shaft 29 journaled in the end frames 15 and 16 and in close proximity to the roller 24. Interposed between the rollers 24 and 26 and the rollers 24 and 28 a hollow vane 35 is provided extending between and supported by the end frames 15 and 16 and having an upper wall portion 36 and a lower wall portion 37, connected by longitudinal end walls 38 and 39 and transverse end walls 40. The wall portion 36 has a plurality of fluid delivery openings 41 therethrough.

A fluid supply connection 42 is provided, communicating with the interior of the hollow vane 35 for delivery of liquid thereto from a pump 43 which is compatible with the liquid in the interior of the tank in which the turnaround is used, the tank having a fluid discharge connection (not shown) for return of liquid to the pump 43. The wall portion 36 is located so that the leading edge of a web and the remainder of the web being processed and advancing from between the rollers 24 and 26 is guided by the liquid passing outwardly through the fluid delivery openings 41 and directed along the wall portion 36 and the fluid thereon towards the space between the rollers 24 and 28 for further advance.

A roller 30 is provided, at the same elevation as the roller 26, on a shaft 31 journaled in the end frames 15 and 16 and in close proximity to the roller 24. Interposed between the rollers 24 and 28 and the rollers 24 and 30 a hollow vane 45 is provided similar to the vane 35 but differentially oriented extending between and supported by the end frames 15 and 16 and having an inner wall portion 46 and an outer wall portion 47, connected by longitudinal end walls 48 and 49 and transverse end walls 50. The wall portion 46 has a plurality of fluid delivery openings 51 therethrough like the openings 41 in the vane 35.

A fluid supply connection 52 is provided, communicating with the interior of the hollow vane 45 for delivery of liquid thereto from the pump 42 which is compatible with the liquid in the interior of the tank in which the turnaround is used. The wall portion 46 is located so that the leading edge of a web and the remainder of the web being processed and advancing from between the rollers 24 and 28 is guided by the liquid passing outwardly through the fluid delivery openings 51 and directed along the wall portion 46 and the fluid thereon towards the space between the rollers 24 and 30 for further advance upwardly through the upfeed section 18.

Figure 1:
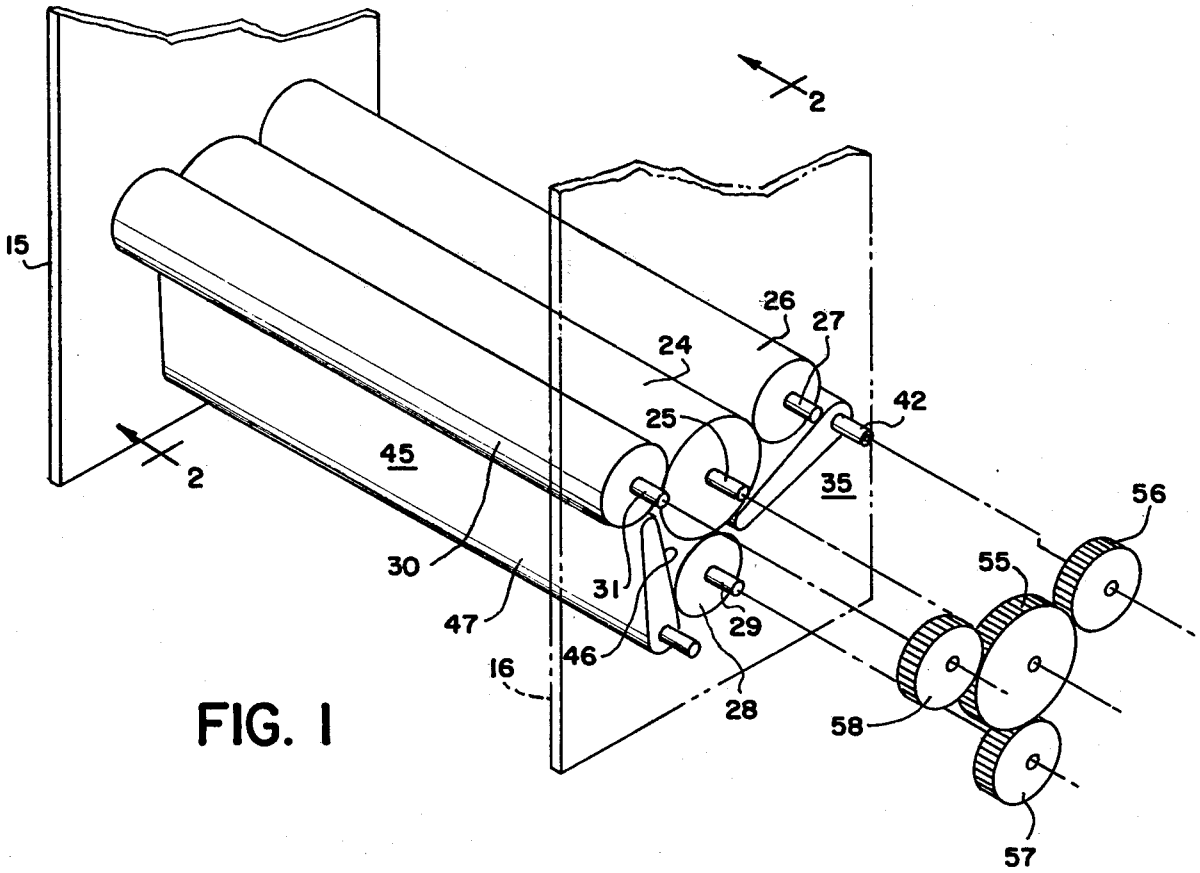
FIG. 1 is a view in perspective of one embodiment of web processing apparatus in accordance with the invention with the end frames shown in phantom and with the driving gears moved outwardly with respect to one of the end frames in the interest of clarity.

In order to actuate the turnaround, and as shown in FIG. 1, the shafts 25, 27, 29 and 31 have gears 55, 56, 57 and 58 secured thereto, the gears 56, 57 and 58 meshing with the gear 55. The gear 55 may be driven in any desired manner from or through the downfeed section 17 or the upfeed section 18 or both.

The mode of operation should be apparent from the foregoing but will be summarized briefly.

The gears 55, 56, 57 and 58 are actuated to rotate the shafts 25, 27, 29 and 31.

The leading edge of a web advanced downwardly in the downfeed section 19 and guided in the turnaround by the rollers 24 and 26 and in the processing liquid therearound, advances toward the upper wall portion 36 where the liquid discharging from the delivery openings 41 guides the leading edge of the web along the wall portion 36 of the vane 35, but spaced therefrom by the liquid being discharged through the openings 41, the remainder of the web also being aided in its advance to and between the space between rollers 24 and 28. As the leading edge of the web and the web itself is advanced toward the wall portion 46 of the vane 45 it is deflected upwardly but spaced therefrom by the liquid being discharged through the openings 51 and advances for delivery to the space between the rollers 24 and 30 for movement therebeyond upwardly in the upfeed section 18 of the roller transport system.

We claim:

1. In apparatus for processing photographic material by conveying an elongated web for turnaround in a confined space comprising space frame members, means carried by said spaced frame members for directing the web in an arcuate path, said means comprising a hollow vane having a wall portion with fluid delivery openings therethrough for directing the leading edge of a web and the web in an arcuate path.

2. Apparatus as defined in claim 1 in which said means further comprises a plurality of parallel web advancing rollers rotatably supported by said frame members.

3. Apparatus as defined in claim 2 in which said hollow vane is disposed between pairs of parallel web advancing rollers.

4. Apparatus as defined in claim 2 in which one of said rollers comprises a central roller with web advancing rollers spaced from said central roller and disposed around a portion of the periphery of said central roller, and at least one of said hollow vanes is disposed in spaced relation to said central roller for deflecting the web along said central roller.

5. Apparatus as defined in claim 4 in which said hollow vane has a wall portion substantially horizontally disposed with fluid delivery openings.

6. Apparatus as defined in claim 4 in which said hollow vane has a wall portion substantially vertically disposed with fluid delivery openings.

7. Apparatus as defined in claim 2 in which driving means is provided for said web advancing rollers.

* * * * *